United States Patent [19]

Schumacher et al.

[11] 4,087,987

[45] May 9, 1978

[54] DEFROST PRESSURE CONTROL SYSTEM

[75] Inventors: Frank A. Schumacher; John E. Sterling, both of Louisville, Ky.

[73] Assignee: General Electric Company, Louisville, Ky.

[21] Appl. No.: 729,999

[22] Filed: Oct. 6, 1976

[51] Int. Cl.[2] ..... F25D 21/06

[52] U.S. Cl. ..... 62/276; 62/174; 62/503

[58] Field of Search ..... 62/174 X, 83, 80, 503 X, 62/276, 151

[56] References Cited

U.S. PATENT DOCUMENTS

| | | | |
|---|---|---|---|
| 2,682,756 | 7/1954 | Clark et al. | 62/502 |
| 3,006,155 | 10/1961 | Vanderlee et al. | 62/174 |
| 3,065,610 | 11/1962 | Maudlin | 62/174 |
| 3,301,001 | 1/1967 | McKinney | 62/174 |

*Primary Examiner*—William E. Wayner
*Assistant Examiner*—R. J. Charvat
*Attorney, Agent, or Firm*—Steven C. Schnedler; Francis H. Boos

[57] ABSTRACT

The defrost pressure control system for a refrigerator includes a reservoir connected in communication with the evaporator of the refrigerating system. The reservoir is placed in heat exchange relationship with a portion of the refrigerator which remains at a relatively low temperature during defrosting so that a portion of the refrigerant in the system condenses in the reservoir during defrosting, thereby being effectively removed from the refrigerating system. A suitable heat sink may also be employed in the heat exchange relationship with the reservoir. Because of withdrawal of the aforementioned refrigerant, the pressure in the refrigerating system at the end of the defrosting operation is substantially below that which would otherwise be present. As a result the torque required to start the compressor is significantly reduced, thereby insuring effective starting of the compressor even when driven by an electric motor having a relatively low starting torque. As soon as the compressor resumes operation, the pressure in the evaporator is substantially reduced to a level well below that in the reservoir and the liquid refrigerant in the reservoir partially vaporizes and all the refrigerant in the reservoir, both gas and liquid, is returned promptly to the refrigerating system, insuring effective normal operation of the refrigerating system.

11 Claims, 5 Drawing Figures

DEFROST PRESSURE CONTROL SYSTEM

BACKGROUND OF THE INVENTION

1. Field of the Invention

This invention relates to refrigerating systems and more particularly to a defrost pressure control system employed in refrigerating systems for facilitating easier starting of the compressor of such refrigerating systems after a defrosting operation.

2. Description of the Prior Art

Refrigerating systems, particularly those used with household refrigerators, usually include a compressor driven by an electric motor of relatively small horsepower. Moreover, the motor usually has a low starting torque, particularly since, for reasons of economy, such motors employed with present day household refrigerators normally do not include a capacitor start winding. When the pressure in such a refrigerating system has equalized during and at the end of a defrosting cycle, the pressure which has to be overcome by the compressor in its initial stroke may be such that the force required exceeds the starting torque of the electric motor which drives the compressor.

The present invention is directed to an improvement associated with such refrigerating systems which insures that the required starting torque does not exceed that which is available from the driving electric motor. This is accomplished by providing a reservoir associated in a particular manner with the refrigerating system for causing a portion of the refrigerant in the system to be withdrawn therefrom to the reservoir in liquid form during the defrosting operation, thereby reducing the amount of refrigerant in the system, and hence the pressure thereof, when the compressor starts after the conclusion of the defrosting operation. This reduces the force which must be exerted by the piston of the compressor during its initial stroke after defrosting and hence correspondingly reduces the starting torque required of the electric motor which drives the compressor.

The prior art includes numerous examples of reservoirs associated with refrigerating systems, such reservoirs being designed to contain a portion of the refrigerant under certain operating conditions. However, none of these prior art devices of which the applicants are aware disclose an arrangement in which the reservoir is specifically provided to withdraw liquid refrigerant from the system during a defrosting operation for the purpose of facilitating the starting of the compressor at the conclusion of the defrosting operation.

Thus, the prior art includes, for example, heat pump systems wherein refrigerant is removed from the system when the heat pump is used for heating purposes and returned to the system when the heat pump is used for cooling, because less refrigerant is needed during the heating cycle. None of these systems, however, involve any consideration of defrosting nor of the problems of starting a compressor after defrosting nor of the desirability of reducing pressure in the refrigerating system to facilitate starting of the compressor after defrosting.

Another example of a prior art system utilizing a reservoir connected with a refrigerating system places the reservoir in a location where the temperature is above normal and uses it while the refrigerating compressor is running rather than idle. Therefore, it does not consider the problem of starting a compressor, which is the specific problem solved by the applicants' system; it is not concerned with defrosting; and, as will be explained later in the specification, the applicants' system requires that the reservoir be placed where the temperature is below that existing in the refrigerating system during defrosting.

Another prior art system utilizing a reservoir connected with the refrigerating system includes a sight glass in the reservoir and is intended to be used to determine whether the proper refrigerant charge is being maintained in the system. It is concerned in no way with withdrawing refrigerant during defrosting so as to make restarting of the compressor at the termination of the defrosting operation easier.

Another prior art system incorporating a reservoir is arranged so that refrigerant is stored therein during normal operation and released from storage during defrosting, exactly the opposite of that required for effective operation of the applicants' system.

Other prior art refrigerating systems including an associated reservoir have utilized such a reservoir in order to provide a means for varying the refrigerant in the system in order to vary the effective condenser surface or the number of a plurality of capillaries effectively utilized in the system. The systems disclosed were not concerned with defrosting nor with the problem of starting a compressor after defrosting. Moreover, these particular systems required an electric heater associated with the reservoir to drive refrigerant from the reservoir.

In contrast to the above-described prior art systems, none of which is concerned with defrosting and the problem of start-up of the compressor after a defrosting operation, the applicants' system provides a simple and effective arrangement for automatically removing a substantial portion of refrigerant from the refrigerating system and storing it in a reservoir in liquid form during defrosting. Thus, the total pressure in the system at the end of the defrosting operation is reduced and the torque required of the electric motor in starting the compressor after defrosting is substantially reduced. The problem of failure of the motor to provide sufficient torque to start the compressor after defrosting is eliminated. Further, in the applicants' system, the stored refrigerant is automatically and promptly returned to the refrigerating system as soon as normal operation has been resumed after conclusion of the defrosting operation.

Accordingly, it is an object of this invention to provide a defrost pressure control system which facilitates easy starting of the refrigerant compressor after a defrosting operation.

It is another object of this invention to provide a defrost pressure control system by which the amount of refrigerant in the system is automatically reduced during defrosting to facilitate easier starting of the compressor after the defrosting operation is completed and by which the stored refrigerant is automatically returned to the refrigerating system when normal operation of the system is resumed.

SUMMARY OF THE INVENTION

In carrying out this invention, in one form thereof, a reservoir is connected in communication with the refrigerating system in the region of the evaporator of the refrigerating system. The reservoir is placed in heat exchange relationship with a portion of the refrigerator which remains at a relatively low temperature during defrosting so that a portion of the refrigerant in the system condenses in the reservoir during defrosting, thereby being effectively removed from the refrigerating system. In order to insure continuation of a sufficiently low temperature in the reservoir during the entire defrosting cycle, a suitable heat sink may also be employed in the heat exchange relationship with the reservoir. Because of withdrawal of the aforementioned refrigerant, the pressure in the refrigerating system at the end of the defrosting operation is substantially below that which would otherwise be present. As a result the torque required to start the compressor is significantly reduced, thereby insuring effective starting of the compressor even when driven by an electric motor having a relatively low starting torque. As soon as the compressor resumes operation, the pressure in the evaporator is substantially reduced to a level well below that in the reservoir and the condensed refrigerant in the reservoir partially vaporizes and all of the refrigerant in the reservoir, both gas and liquid, is returned promptly to the refrigerating system, insuring effective normal operation of the refrigerating system.

DESCRIPTION OF THE DRAWINGS

The defrost pressure control sytem of this invention and the operation thereof may be more readily understood by reference to the drawings, in which.

DESCRIPTION OF THE PREFERRED EMBODIMENTS

Figure 1:
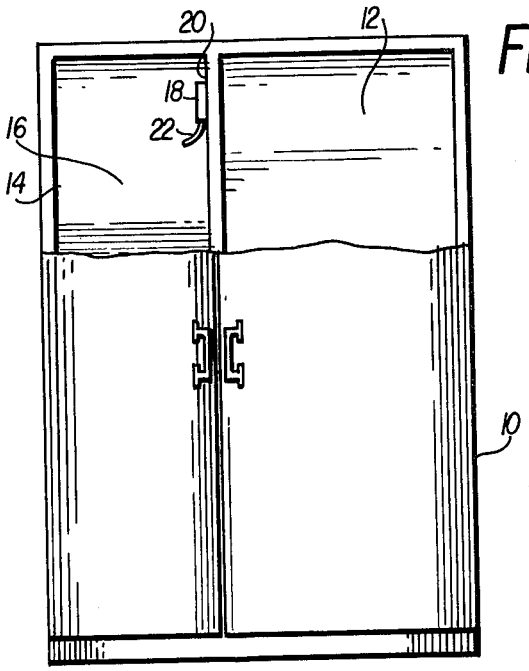
FIG. 1 shows a household refrigerator, partly broken away, incorporating an embodiment of this invention.

Referring to FIG. 1, there is shown the general outline of a household refrigerator 10 which includes a fresh food compartment 12 and a freezer compartment 14. An evaporator (not shown in this figure) is arranged in heat exchange relationship with a portion of the outside surface of the rear wall 16 of the freezer compartment. Provision is made for circulating air from the freezer compartment to the fresh food compartment for maintaining a proper temperature in the fresh food compartment. The details of the particular arrangement for cooling the freezer compartment and the fresh food compartment are not part of this invention and any of a number of conventional arrangements may be employed.

It is customary to provide for periodic defrosting of the evaporator at intervals, defrosting usually being accomplished by providing a radiant electric heater 17 (FIG. 2) in the evaporator area to melt the frost which has collected thereon. In one conventional form, the resulting liquid is simply discharged into a pan positioned in the machinery compartment of the refrigerator ad evaporates therefrom. During defrosting the pressure in the refrigerating system increases substantially and at the conclusion of the defrosting operation the pressure in the system may be such that the electric motor driving the compressor is unable to provide sufficient torque to restart the compressor, particularly where the power supplied from the utility lines is at a lower than normal voltage.

In accordance with the present invention, provision is made for insuring that the pressure in the system at the conclusion of the defrosting operation is sufficiently low that a motor having a relatively low starting torque is able to restart the compressor even under low voltage conditions. The defrost pressure control system of this invention includes a reservoir 18 for collecting therein a portion of the refrigerant of the refrigerating system under particular conditions. The reservoir 18 is shown arranged in heat exchange relationship with a side wall 20 of the freezer compartment in the upper portion thereof. The reservoir is connected in communication with the refrigerating system by a tube 22 in a manner which will be more fully described in connection with FIGS. 2 and 3.

Figure 2:
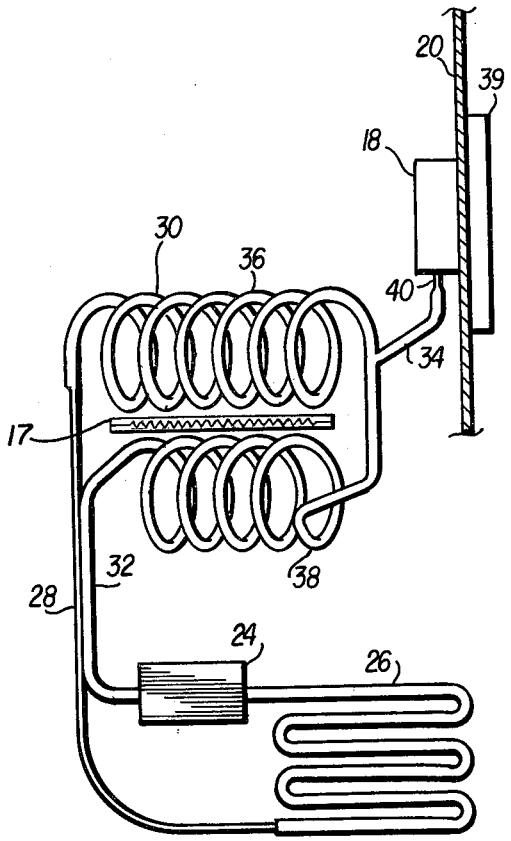
FIG. 2 illustrates schematically a refrigerating system incorporating the defrost pressure control system of this invention.
Figure 3:
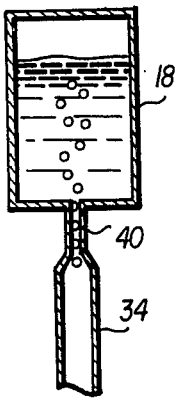
FIG. 3 is an enlarged view of the reservoir employed in this invention, showing the condition of the reservoir during the defrosting operation.

Turning now to FIG. 2, there is shown in schematic form a refrigerating system suitable for use with such a household refrigerator. This refrigerating system includes a compressor 24. The compressor is shown only schematically but it will be understood that the component designated as the compressor 24 actually includes, in a conventional manner, a hermetically sealed case in which is arranged a compressor driven by a suitable electric motor. The compressor is connected to a condenser 26 where the compressed refrigerant is cooled and condensed. The condensed refrigerant is supplied through a restrictor or capillary 28 to an evaporator 30 where the condensed refrigerant vaporizes to effect cooling of the refrigerator. The vaporized refrigerant is returned to the compressor to complete the cycle through a suction line 32 which is arranged, in a conventional manner, in heat exchange relation with the capillary 28.

As is well known, because of the temperature at which the evaporator is required to operate, frost tends to build up thereon during the normal refrigerating cycle. Modern refrigerators have incorporated therein means for automatically removing this frost at intervals so it does not build up to excessive amounts. This is accomplished by automatically discontinuing the refrigerating operation by stopping running of the compressor and heating the area of the evaporator to a temperature sufficient to melt the frost thereon. Thereafter, the normal refrigerating operation is resumed. However, this automatic defrosting operation introduces a problem since the pressure in the refrigerating system increases substantially during the defrosting operation, and the compressor, as the refrigerating operation is resumed, must restart with this substantial pressure in the system. The starting torque of the motor which drives the compressor must, or course, be sufficient to effect restarting of the compressor against this substantial pressure. Since it may be desirable, for economy reasons to provide a motor which does not include, for example, a capacitor start winding, the motor may have a relatively low starting torque. This may be insufficient to start the compressor under the conditions existing at the conclusion of defrosting, particularly where there is a temporary undervoltage on the power lines supplying power to the refrigerator. Even a single instance of such failure to start presents a serious problem to the user who is accustomed to automatic and essentially attention-free operation of the household refrigerator. By the arrangement of this invention the pressure existing in the refrigerating system at the conclusion of the defrosting operation is substantially reduced, thereby insuring that even a motor having a relatively low starting torque will provide sufficient torque to start the compressor again at the conclusion of defrosting operation in all instances.

Referring now again to FIG. 2, the reservoir 18 is connected in communication with the refrigerating system in the region of the evaporator 30 by means of a connecting tube 34. In the specific embodiment shown in FIG. 2 the evaporator 30 comprises two sections 36 and 38 and the tube 34 is connected to the evaporator intermediate these two sections, that is, substantially at the midpoint of the evaporator, but the system of this invention is not limited to connection at the midpoint of the evaporator.

As previously indicated, the reservoir 18 is positioned in heat exchange relationship with a side wall 20 of the freezer compartment. This wall, of course, during normal operation of the refrigerating system, is at a relatively low temperature, in the order of 0° F. The evaporator, as also previously indicated in describing FIG. 1, is positioned adjacent the rear wall 16 of the freezer compartment. During the defrosting operation the temperature of the evaporator and the area immediately adjacent thereto is raised above 32° F. in order to melt the frost which has collected thereon. However, because of the relatively low temperature which has been established in the freezer compartment, the temperature of that compartment and of the wall 20 remains significantly below 32° F throughout the defrosting operation. Because of the low temperature maintained in the reservoir 18 during the defrosting operation relative to that in the refrigerating system and particularly in the evaporator, a portion of the refrigerant in the refrigerating system automatically flows to the reservoir and condenses therein, as shown more clearly in the cross-sectional view in FIG. 3. This effectively removes a substantial portion of the refrigerant from the refrigerating system and causes it to be stored in the reservoir 18 in liquid form, thereby reducing the amount of charge in the refrigerating system itself and as a result reducing the pressure existing in the refrigerating system at the termination of the defrosting operation. By way of specific example, a refrigerating system for a household refrigerator may be designed to operate with a refrigerant charge in the order 5-½ ounces to 6-½ ounces. The reservoir 18 in this particular example is sized so as to hold approximately 1 to 2 ounces of refrigerant, thereby removing a significant portion of the refrigerant from the refrigerating system. Without the inclusion of the reservoir of this invention, the pressure in the refrigerating system utilizing a refrigerant charge of 5-½ to 6-½ ounces would be, at the end of the defrosting operation, approximately 60 psig. With the use of the reservoir of this invention, thereby removing 1 to 2 ounces of refrigerant from the system, the pressure, which is substantially equalized throughout the refrigerating system at the end of the defrosting operation, is reduced substantially, to approximately 40 psig. This reduction in pressure substantially reduces the torque which must be exerted to start the compressor at the end of the defrosting operation.

A motor having a relatively low starting torque, such as one not having a capacitor start winding, will still have sufficient torque to start the compressor in all instances. Moreover, the starting torque required is such that easy starting is insured even under conditions of reduced voltage supply to the electric motor.

It will be apparent that the size of the reservoir relative to the amount of refrigerant charge in the refrigerating system may be varied from that described above. If a larger reservoir is used, thereby permitting removal of a greater amount of refriegerant, the pressure in the system at or near the conclusion of the defrosting cycle will be still further reduced. Conversely if a somewhat smaller reservoir is employed, thereby reducing the amount of refrigerant condenser in the reservoir during the defrosting cycle, the pressure in the refrigerating system at the end of the defrosting cycle will be correspondingly greater.

During normal operation, that is, during the time the refrigerating system is operating to cool the refrigerator, the reservoir remains essentially empty because the evaporator is then colder than the reservoir 18 and the wall 20 with which it is associated. Moreover, in the embodiment illustrated in FIG. 2, the reservoir is "uphill" from the evaporator, that is, at a higher level than the evaporator, thereby further insuring against the collection of any significant amount of refrigerant, that is, anything except for some limited amount of superheated gas, in the reservoir during normal operation. It is not essential to the operation of the system of this invention that the reservoir be above the level of the evaporator since the fact that the evaporator, during normal operation, is at a lower temperature than the reservoir tends to minimize any collection of refrigerant in the reservoir. However, in the preferred embodiment, the reservoir is so arranged because it further contributes to the effectiveness of the system.

In normal hermetically sealed refrigerating system lubricant for lubricating the moving parts of the compressor is included with the refrigerant charge and is miscible therewith. A portion of this lubricant tends to collect in the reservoir 18 during the defrosting cycle and it is desirable that this lubricant be returned to the refrigerating system when the defrosting operation is completed and normal refrigerating operation is resumed. The arrangement of the reservoir 18 "uphill" of the evaporator 30 has the additional advantage of facilitating complete return of the lubricant from the reservoir to the refrigerating system.

In order to further insure that the reservoir 18 remains at a sufficiently low temperature throughout the defrosting operation, a suitable heat sink may be incorporated in heat exchange relationship with the reservoir. In the embodiment shown in FIG. 2, the heat sink comprises a metal plate 39, which may be of aluminum, of sufficient size and thickness to insure that the reservoir remains at a sufficiently low temperature. It will be understood that other types of heat sinks, such as a suitable eutectic solution, may be employed in lieu of the plate 39 in heat exchange relationship with the reservoir 18.

In order to prevent condensed refrigerant from flowing by gravity back into the evaporator from the reservoir during the defrosting operation, a restrictor 40 is provided in the tube 34 adjacent the bottom of the reservoir 18. This restrictor is of such diameter that the gas bubbles flowing upwardly through the tube 34 and restrictor 40 block any counterflow of condensed refrigerant through the restrictor 40. The optimum size will, of course, vary with the refrigerating system and the amount of refrigerant employed, but in the particular embodiment described above a restrictor diameter of approximately ⅛ inch is considered satisfactory to prevent counterflow of condensed refrigerant from the reservoir through the restrictor 40.

With the system described above, the pressure in the refrigerating system and in the hermetically sealed case in which the electric-motor-driven compressor is arranged is sufficiently low that the compressor is easily started by the motor at the conclusion of the defrosting operation and the resumption of the refrigerating mode. When the defrost heating is discontinued and the refrigerating mode is resumed, the pressure in the evaporator 30 is very rapidly reduced. This causes the liquid refrigerant in the reservoir 18 to be partially vaporized very quickly and the difference in pressure between the reservoir and the evaporator causes the refrigerant in the reservoir, essentially all of which is in liquid form, to be returned promptly to the refrigerating system. Thus the refrigerating system almost immediately begins operation with the full refrigerant charge therein so that the operation of the refrigerating system is completely normal. This change occurs so quickly that the refrigerant in the reservoir literally "erupts" from the reservoir back into the refrigerating system.

This prompt return of the refrigerant in liquid form to the evaporator provides an ancillary benefit of the system of this invention. This liquid refrigerant is immediately available to produce refrigeration in the evaporator whereas in a conventional refrigerating system there is a significant time delay, in the order of one minute, before "new" liquid refrigerant reaches the evaporator from the compressor and condensor to produce cooling. The amount of cooling provided by the liquid refrigeration returned to the evaporator from the reservoir is relatively small, being approximately 8 BTU where 2 ounces of refrigerant have been stored in the reservoir. However, it does provide the advantage of furnishing some cooling promptly during the interval while the main body of refrigerant is being compressed and condensed and before this main body of refrigerant can be supplied to the evaporator for cooling the evaporator.

Figure 4:
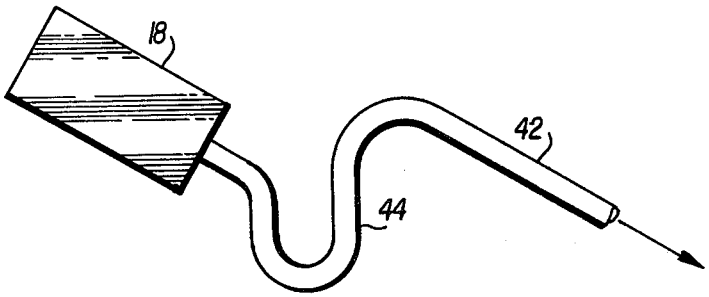
FIG. 4 is a schematic view of a modified form of this invention.
Figure 5:
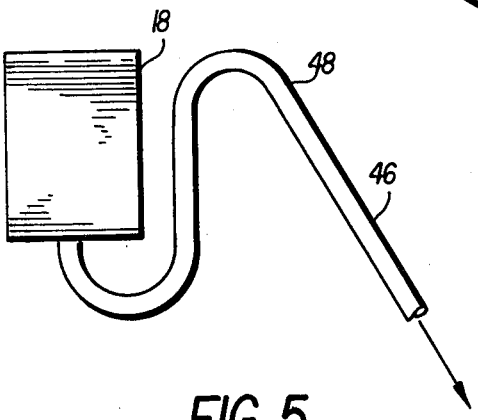
FIG. 5 is a schematic view of another modified form of this invention.

In lieu of employing the restrictor 40 for preventing return flow or counterflow of condensed refrigerant to the refrigerating system during the defrosting operation, the modified arrangements shown in FIGS. 4 and 5 may be employed. In the arrangement shown in FIG. 4, a tube 42 is provided between the reservoir 18 and the evaporator in lieu of the tube 34 in the embodiment just described. Thus tube 42 includes a U-shaped section or trap 44 adjacent the reservoir 18. Gas bubbles of refrigerant from the refrigerating system pass through the trap 44 to the reservoir 18 and condense therein during the defrosting operation but return flow or counterflow of condensed refrigerant from the reservoir 18 to the evaporator is prevented by the trap and the gas bubbles flowing therethrough.

In the second modified arrangement, which is shown in FIG. 5, a tube 46 is employed to connect the reservoir 18 in communication with the evaporator. In this modification, the tube 46 is formed to include a gooseneck 48 which extends upwardly approximately to or slightly above the top of the reservoir 18 and thereby effectively prevents counterflow of condensed liquid refrigerant from the reservoir 18 back to the refrigerating system during the defrosting operation.

From the above description it can be seen that by this invention a portion of the refrigerant normally employed in a refrigerating system is automatically removed therefrom and collected in a reservoir during the defrosting operation. The pressure in the refrigerating system at the conclusion of the defrosting operation is therefore substantially reduced from that which would otherwise be present. This correspondingly reduces the torque necessary to start the compressor as the refrigerating mode is resumed at the conclusion of the defrosting operation. Therefore, easy and certain starting of the compressor at that time is insured even when a relatively low starting torque electric motor is employed to drive the compressor and even under conditions of reduced voltage supply to the electric motor from the power lines. Moreover, by this invention, the refrigerant which has condensed in the reservoir during the defrosting operation is automatically returned to the refrigerating system promptly after the resumption of a refrigerating mode, so that the full refrigerating charge is immediately available to the refrigerating system for completely normal operation thereof. Moreover, the liquid refrigerant returned from the reservoir to the evaporator provides immediate cooling of the evaporator in the interval required for "new" liquid refrigerant to reach the evaporator from the compressor and condenser after the refrigerating mode has been resumed upon termination of defrosting.

While particular structures for carrying out this invention have been shown and described, it is apparent that the invention is not limited to the specific embodiments so shown and described and it is intended by the appended claims to cover all embodiments which come within the spirit and scope of this invention.

What is claimed as new and desired to be secured by Letters Patent of the United States is:

1. In a refrigerator system including a compressor, condenser and evaporator connected in series, and a heater for defrosting the evaporator as required, the compressor not running during a defrosting operation, a defrost pressure control system comprising:

(a) a reservoir for receiving a portion of the refrigerant employed in said refrigerating system; and (b) means connecting said reservoir in communication with said refrigerating system in the region of said evaporator;

(c) said reservoir being positioned in heat exchange relationship with a region which remains relatively cold during defrosting for causing a portion of the refrigerant to condense is said reservoir during defrosting; and (d) condensed refrigerant in said reservoir being caused to be partially vaporized and to be returned to said refrigerating system as both gas and liquid when said compressor is started and reduces pressure in said evaporator after termination of defrosting.

2. The defrost pressure control system of claim 1, wherein said reservoir is positioned above the level of said evaporator and further including means for preventing return flow of condensed refrigerant from said reservoir to said refrigerating system during defrosting.

3. The defrost pressure control system of claim 2, wherein said means for preventing return flow of condensed refrigerant comprises a restrictor in said connecting means.

4. The defrost pressure control system of claim 2, wherein said means for preventing return flow of condensed refrigerant comprises a trap in said connecting means.

5. The defrost pressure control system of claim 2, wherein said means for preventing return flow of condensed refrigerant comprises a gooseneck in said connecting means, said gooseneck extending to a level corresponding approximately to the level of the top of said reservoir.

6. The defrost pressure control system of claim 1, wherein said liquid refrigerant from said reservoir provides prompt cooling of said evaporator before liquid refrigerant can be supplied to the said evaporator by said compressor after termination of defrosting.

7. The defrost pressure control system of claim 1, wherein said connecting means is connected to said evaporator intermediate the ends of said evaporator.

8. The defrost pressure control system of claim 1, and further including a heat sink positioned in heat exchange relationship with said reservoir to insure that said reservoir remains at a sufficiently low temperature throughout defrosting to prevent vaporization of said condensed refrigerant during defrosting.

9. In a refrigerator including a fresh food compartment and a freezer compartment and including a refrigerating system comprising a compressor, condenser and evaporator in series, and a heater for defrosting the evaporator as required, the compressor not running during a defrosting operation, a defrost control system comprising:

(a) a reservoir for receiving a portion of the refrigerant employed in said refrigerating system; and (b) means connecting said reservoir in communication with said refrigerating system in the region of said evaporator;

(c) said reservoir being positioned in heat exchange relationship with a wall of said freezer compartment for causing a portion of the refrigerant to condense in said reservoir during defrosting; and (d) condensed refrigerant in said reservoir being caused to be partially vaporized and to be returned to said refrigerating system as both gas and liquid when said compressor is started and reduces pressure in said evaporator after termination of defrosting.

10. The defrost pressure control system of claim 9, wherein said reservoir is positioned above the level of said evaporator, and further including means for preventing return flow of condensed refrigerant from said reservoir to said refrigerating system during defrosting.

11. The defrost pressure control system of claim 9, and further including a heat sink secured to said wall in heat exchange relationship with said reservoir to insure that said reservoir remains at a sufficiently low temperature throughout defrosting to prevent vaporization of said condensed refrigerant during defrosting.

* * * * *